US008387289B2

(12) United States Patent
Hanakawa et al.

(10) Patent No.: US 8,387,289 B2
(45) Date of Patent: Mar. 5, 2013

(54) HYDRAULIC CIRCUIT SYSTEM FOR HYDRAULIC EXCAVATOR

(75) Inventors: Kazuyoshi Hanakawa, Tsuchiura (JP); Makoto Mitsuhashi, Ibaraki-ken (JP); Tsuyoshi Nakamura, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 294 days.

(21) Appl. No.: 12/992,972

(22) PCT Filed: Feb. 26, 2010

(86) PCT No.: PCT/JP2010/053156

§ 371 (c)(1),
(2), (4) Date: Nov. 16, 2010

(87) PCT Pub. No.: WO2010/116816

PCT Pub. Date: Oct. 14, 2010

(65) Prior Publication Data

US 2011/0061755 A1 Mar. 17, 2011

(30) Foreign Application Priority Data

Apr. 6, 2009 (JP) ..... 2009-092112

(51) Int. Cl.
*E02F 3/43* (2006.01)
*E02F 9/22* (2006.01)

(52) U.S. Cl. ..... 37/348; 60/328

(58) Field of Classification Search ..... 37/347, 37/348, 466; 172/2–11; 701/50; 60/328, 60/368, 429, 484, 399, 403; 91/1, 34, 459, 91/461, 530

See application file for complete search history.

(56) References Cited

U.S. PATENT DOCUMENTS

| | | | | |
|---|---|---|---|---|
| 5,537,819 | A * | 7/1996 | Kobayashi | 60/459 |
| 5,692,376 | A * | 12/1997 | Miki et al. | 60/328 |
| 6,546,325 | B1 * | 4/2003 | Kubota et al. | 701/50 |
| 7,478,530 | B2 * | 1/2009 | Ueda | 60/399 |
| 7,810,321 | B2 * | 10/2010 | Yamashita et al. | 60/328 |
| 2008/0296522 | A1 | 12/2008 | Yamashita et al. | |

FOREIGN PATENT DOCUMENTS

| | | | |
|---|---|---|---|
| JP | 2002-294758 | A | 10/2002 |
| JP | 2004-74331 | A | 3/2004 |
| JP | 2004-76411 | A | 3/2004 |
| JP | 2008-133842 | A | 6/2008 |

* cited by examiner

*Primary Examiner* — Robert Pezzuto
(74) *Attorney, Agent, or Firm* — Mattingly & Malur, PC

(57) ABSTRACT

A hydraulic circuit system for a hydraulic excavator, which has a hydraulic circuit for an attachment, includes: a directional control valve 16 that supplies a hydraulic fluid to an attachment connected to the hydraulic circuit for an attachment; a first over-load relief valve unit 38 that is provided in one of lines of the hydraulic circuit for an attachment; a second over-load relief valve unit 39 that is provided in the other of the lines of the hydraulic circuit for an attachment; a first proportional solenoid valve 40 that controls set relief pressure of the first over-load relief valve unit 38; and a second proportional solenoid valve 41 that controls set relief pressure of the second over-load relief valve unit 39. The attachment having various characteristics and capacity, such as a hydraulic breaker or a crusher, can be applied to the hydraulic circuit for an attachment in a simple configuration.

5 Claims, 5 Drawing Sheets

HYDRAULIC CIRCUIT SYSTEM FOR HYDRAULIC EXCAVATOR

TECHNICAL FIELD

The present invention relates to a hydraulic circuit system for a hydraulic excavator. The invention relates more particularly to a hydraulic circuit system for a hydraulic excavator, which includes a hydraulic circuit for a front attachment which allows at least a hydraulic breaker and a crusher to be attached as a front attachment for the hydraulic excavator, the hydraulic breaker crushing a rock and the like and the crusher being used for a disassembling operation.

BACKGROUND ART

A hydraulic excavator performs an excavation operation using a bucket. Such a hydraulic excavator has, in the hydraulic circuit of the hydraulic excavator, a hydraulic circuit for an attachment which allows attachments such as a hydraulic breaker and a crusher to be used. The hydraulic breaker crushes a rock and the like, and the crusher is used to perform an excavation operation. The hydraulic circuit for attachments is provided to operate the attachments.

When the hydraulic breaker or the crusher is installed as a front attachment, a variable relief valve is provided in one of hydraulic lines that connect an actuator for an attachment to a directional control valve for operation of the attachment in order to allow the hydraulic breaker or the crusher to be used. The hydraulic line is a part of the hydraulic circuit for an attachment and is provided on the side of the actuator. Pressure of a hydraulic fluid (for pilot operation) that is to be supplied to a pilot operating section included in the variable relief valve is increased or reduced by a set pressure changing device that includes a switch and a solenoid valve so that set pressure of the variable relief valve can be changed (refer to, for example, Patent Document 1).

Patent Document 1: JP, A 2004-76411 (Paragraphs 0056-0059 FIGS. 6 and 7)

SUMMARY OF THE INVENTION

Problem to be Solved by the Invention

A hydraulic excavator's operator installs an attachment having various working abilities, such as the hydraulic breaker or the crusher, as the front attachment on the basis of the work conditions. In this case, it is necessary to change, in response to the operating ability of the attachment such as the hydraulic breaker or the crusher, circuit pressure of the hydraulic circuit for an attachment. In addition, it is necessary to sufficiently consider pressure characteristics of an over-load relief valve as well as the setting of the circuit pressure. For example, when the crusher is installed as an attachment, pressure pulsation that will occur in the hydraulic circuit is small. Thus, pressure of the over-load relief valve should be set at a high level. In addition, when the hydraulic breaker is installed as an attachment, pressure in the hydraulic circuit is low and pulsation of the breaker is high. Thus, it is necessary to set pressure of the over-load relief valve at a value (low value) suitable for the breaker pulsation.

In addition, specifically, hydraulic breakers having different pressure capacities can be supported by coupling one of hydraulic lines of the hydraulic circuit for an attachment with multiple combinations of a stop valve and an over-load relief valve for which pressure values are set. In addition, crushers having different pressure capacities can be supported by coupling the other of the hydraulic lines of the hydraulic circuit for an attachment with multiple over-load relief valves for which pressure values are set.

In this case, however, the multiple combinations of the stop valve and the over-load relief valve for which the pressure values are set need to be installed in the hydraulic circuit for an attachment to support the hydraulic breakers. The multiple over-load relief valves for which the pressure values are set need to be installed in the hydraulic circuit for an attachment to support the crushers. Thus, a hydraulic circuit system becomes complex and cannot be easily configured. Therefore, the cost of the system will be high.

The present invention has been devised based on the aforementioned fact, and an object of the present invention is to provide a hydraulic circuit system for a hydraulic excavator in which attachments having various characteristics and pressure capacities, such as a hydraulic breaker and a crusher can be applied to a hydraulic circuit for an attachment with a simple configuration.

Means for Solving the Problem

In order to accomplish the aforementioned object, a first invention according to the present invention is a hydraulic circuit system for a hydraulic excavator, which includes a hydraulic circuit for an attachment which allows at least a hydraulic breaker and a crusher to be attached as a front attachment for the hydraulic excavator, the hydraulic breaker crushing a rock and the like and the crusher being used for a disassembling operation, the system comprising:

a directional control valve that supplies and discharges a hydraulic fluid to and from an attachment connected to the hydraulic circuit for an attachment;

a first over-load relief valve unit including a check valve and a variable relief valve, the first over-load relief valve unit provided in the one of lines of the hydraulic circuit for an attachment;

a second over-load relief valve unit including a check valve and a variable relief valve, the second over-load relief valve unit provided in the other of the lines of the hydraulic circuit for an attachment;

a breaker relief valve and a breaker relief stop valve that are provided between the one of the lines of the hydraulic circuit for an attachment and the other of the lines of the hydraulic circuit for an attachment;

a first proportional solenoid valve that is connected to the relief valve included in the first over-load relief valve unit and the breaker relief valve, the first proportional solenoid valve for controlling set pressure of the relief valve included in the first over-load relief valve unit and set pressure of the breaker relief valve;

a second proportional solenoid valve that controls set pressure of the relief valve included in the second over-load relief valve unit; and a solenoid valve that opens and closes the breaker relief stop valve.

In the first invention, a second invention according to the present invention is characterized by comprising a directional control valve that is provided in the other of the lines of the hydraulic circuit for an attachment, the directional control valve being connected to the breaker on the side of a tank, wherein the directional control valve can be opened and closed in operative association with opening and closing operations of the breaker relief valve.

In the first invention, a third invention according to the present invention is characterized by comprising a work input setting device that changes a work mode and set values and selects the type of the attachment such as the hydraulic breaker or the crusher having crushing nails; and a controller used to open and close the first proportional solenoid valve, the second proportional solenoid valve and the solenoid valve according to a command transmitted from the work input setting device.

In the third invention, a fourth invention according to the present invention is characterized in that the work input setting device includes: a key section that changes the work mode and the set values and selects the type of the attachment; and a screen section that displays the type of the attachment and the state quantity of each device.

In the third invention, a fifth invention according to the present invention is characterized in that the controller receives a command signal from the work input setting device, thereby allowing the first proportional solenoid valve to control set relief pressure of the relief valve included in the first over-load relief valve unit and set relief pressure of the breaker relief valve.

Effects of the Invention

According to the present invention, the hydraulic circuit for an attachment can be easily set and adjusted to be applied to an attachment having various characteristics and pressure capacity, such as a hydraulic breaker or a crusher. As a result, versatility of the hydraulic circuit for an attachment is improved. In addition, it is possible to provide a hydraulic circuit system for a hydraulic excavator which is simple in setting adjustment without increase in cost.

MODE FOR CARRYING OUT THE INVENTION

The following describes a hydraulic circuit system for a hydraulic excavator according to an embodiment of the present invention with reference to the accompanying drawings.

Figure 1:
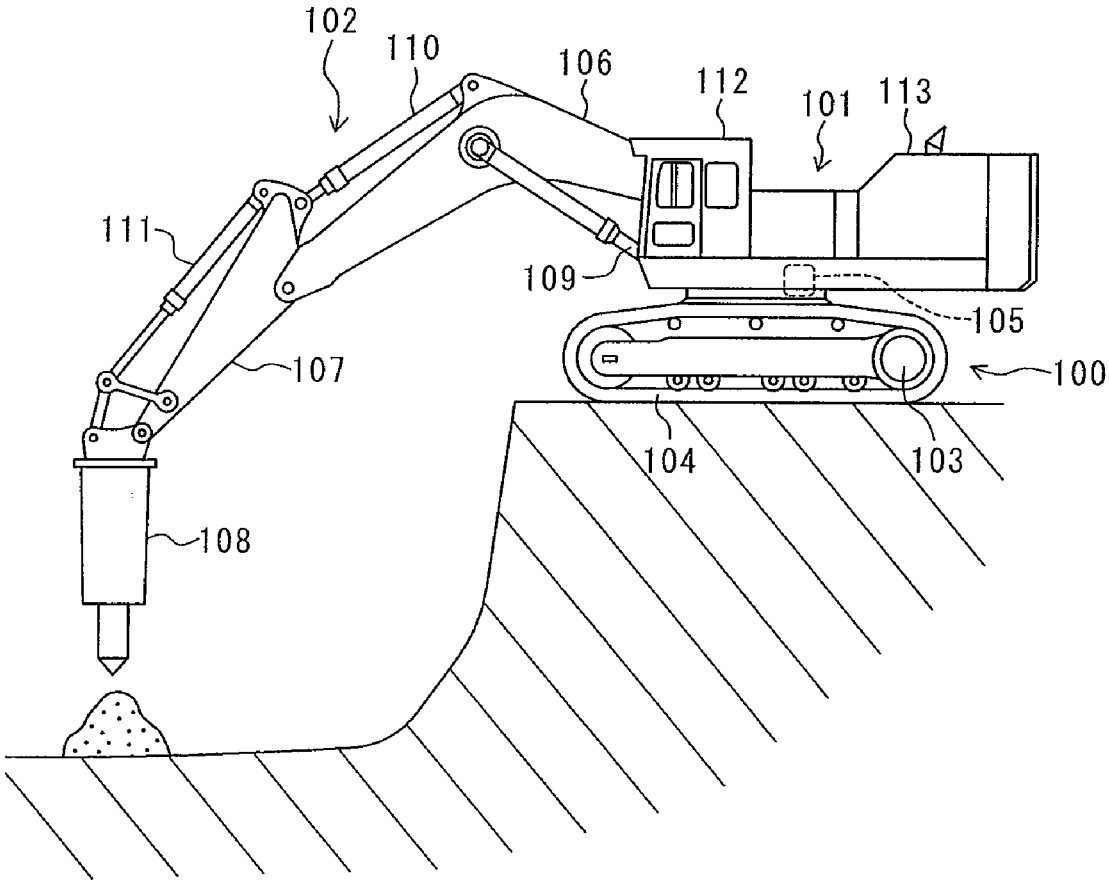
FIG. 1 is a front view of a hydraulic excavator that includes a hydraulic circuit system for a hydraulic excavator according to an embodiment of the present invention and a hydraulic breaker installed thereto.
Figure 2:
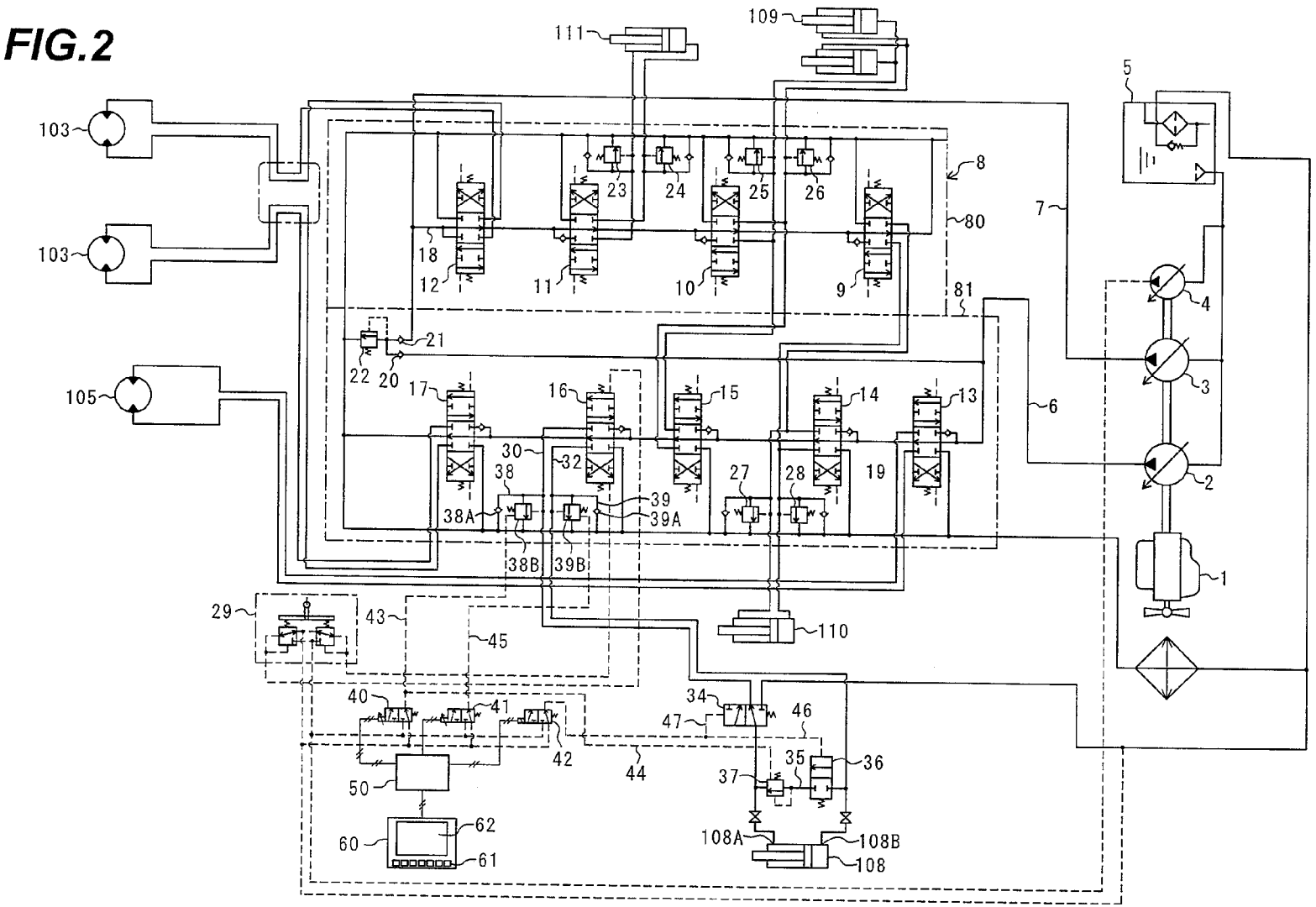
FIG. 2 is a circuit diagram showing the embodiment in which the hydraulic breaker is attached to a hydraulic circuit for an attachment, which is included in the hydraulic circuit system for a hydraulic excavator of the present invention.

FIGS. 1 and 2 show the hydraulic circuit system for a hydraulic excavator according to the embodiment of the present invention. FIG. 1 is a front view of a hydraulic excavator that has the hydraulic circuit system for a hydraulic excavator according to the embodiment of the present invention and a hydraulic breaker installed thereto. FIG. 2 is a circuit diagram of the hydraulic circuit system for a hydraulic excavator according to the embodiment of the present invention.

Referring to FIG. 1, the hydraulic excavator includes a track body 100, a rotating body 101 and a front work device 102. The track body 100 travels by causing left and right travel motors 103 (one of the motors is shown) to drive left and right crawlers 104 (one of the crawlers is shown). The rotating body 101 is rotated on the track body 100 by a rotation motor 105. The front work device 102 has a multi-joint structure that includes a boom 106, an arm 107 and the hydraulic breaker 108. The boom 106 is attached to the rotating body 101 and capable of moving upward and downward. The arm 107 is attached to a front end of the boom 106 and capable of pivoting. The hydraulic breaker 108 is an attachment and is provided instead of a bucket that was attached to a front end of the arm 107. The boom 106, the arm 107 and the hydraulic breaker 108 are driven by a boom cylinder 109, an arm cylinder 110 and a bucket cylinder 111 to swing in a vertical plane, respectively. A cab 112 is provided on the front side of the rotating body 101. A driving source chamber 113 is provided on the back side of the rotating body 101 and has an engine and a hydraulic device.

FIG. 2 is a circuit diagram of the hydraulic circuit system for a hydraulic excavator (shown in FIG. 1) according to the embodiment of the present invention. In FIG. 2, the same reference numerals as those shown in FIG. 1 indicate the same elements, which are not described below in detail.

Referring to FIG. 2, the hydraulic circuit system according to the embodiment includes first and second hydraulic pumps 2 and 3, an auxiliary hydraulic pump 4, a hydraulic operating fluid tank 5, a control valve device 8, the left and right travel motors 103, the rotation motor 105, the boom cylinder 109, the arm cylinder 110 and the hydraulic breaker 108. The control valve device 8 is connected to delivery hydraulic lines 6, 7 of the first and second hydraulic pumps 2, 3. The left and right travel motors 103 are connected to the control valve device 8 and serve as hydraulic actuators. The hydraulic breaker 108 is an example of the attachment and is attached to the front end of the arm 107 instead of the bucket attached to the edge of the arm 107.

The control valve device 8 includes a first valve section 80 and a second valve section 81. The first valve section 80 includes center bypass type directional control valves 9 to 12. The second valve section 81 includes center bypass type directional control valves 13 to 17. The directional control valves 9 to 12 of the first valve section 80 are connected to a center bypass line 18 in the order shown in FIG. 2. The center bypass line 18 is connected to the delivery hydraulic line 7 of the second hydraulic pump 3. The directional control valves 13 to 17 of the second valve section 81 are connected to a center bypass line 19 in the order shown in FIG. 2. The center bypass line 19 is connected to the delivery hydraulic line 6 of the first hydraulic pump 2. The most upstream portions of the center bypass lines 18 and 19 are connected to a main relief valve 22. The main relief valve 22 controls the highest delivery pressure of the first hydraulic pumps 2 and 3 through check valves 20 and 21.

The directional control valve 9 included in the first valve section 80 is connected to the arm cylinder 110 through hydraulic lines on the side of actuator ports of the directional control valve 9 and controls flow of a hydraulic fluid to the arm cylinder 110. The directional control valve 10 is connected to the boom cylinder 109 through hydraulic lines on the side of actuator ports of the directional control vale 10 and controls flow of a hydraulic fluid to the boom cylinder 109. The directional control valve 11 is connected to the bucket cylinder 111 through hydraulic lines on the side of actuator ports of the directional control valve 11 and controls flow of a hydraulic fluid to the bucket cylinder 111. The directional control valve 12 is connected to one of the travel motors 103 through hydraulic lines on side of actuator ports of the directional control valve 12 and controls flow of a hydraulic fluid to the one of the travel motors 103.

In addition, the directional control valve 13 included in the second valve section 81 is connected to the rotation motor 105 through hydraulic lines on the side of actuator ports of the directional control valve 13 and controls flow of a hydraulic fluid to the rotation motor 105. The directional control valve 14 is connected to the arm cylinder 110 through hydraulic lines on the side of actuator ports of the directional control valve 14 and controls flow of a hydraulic fluid to the arm cylinder 110. The directional control valve 15 is connected to the boom cylinder 109 through hydraulic lines on the side of actuator ports of the directional control valve 15 and controls flow of a hydraulic fluid to the boom cylinder 109. The directional control valve 16 is provided for an attachment. In this example, the directional control valve 16 is connected to the hydraulic breaker 108 (that is the attachment) through hydraulic lines on the side of actuator ports of the directional control valve 16 and controls flow of a hydraulic fluid to the hydraulic breaker 108. The directional control valve 17 is connected to the other of the travel motors 103 through hydraulic lines on the side of actuator ports of the directional control valve 17 and controls flow of a hydraulic fluid to the other of the travel motors 103.

The first valve section 80 also has over-load relief valve units 23 and 24 for a bucket in the hydraulic lines located on the side of the actuator ports of the directional control valve 11 for a bucket, while each of the over-load relief valve units 23 and 24 includes a check valve and a relief valve. The first valve section 80 also has over-load relief valve units 25 and 26 for a boom in the hydraulic lines located on the side of the actuator ports of the directional control valves 10, 15 for a boom, while each of the over-load relief valve units 25 and 26 includes a check valve and a relief valve. The second valve section 16 also has over-load relief valve units 27 and 28 for a bucket in the hydraulic lines located on the side of the actuator ports of the directional control valves 9, 14 for a arm, while each of the over-load relief valve units 27 and 28 includes a check valve and a relief valve.

A hydraulic fluid (for pilot operation) is supplied from the auxiliary pump 4 by an operation of a control lever device 29, and the directional control valve 16 for an attachment is switched by means of the hydraulic fluid supplied from the auxiliary pump 4. A hydraulic circuit for an attachment connects the directional control valve 16 for an attachment to the hydraulic breaker 108. The hydraulic circuit for an attachment includes a hydraulic line 30, a line 31, a hydraulic line 32, and a line 33. The hydraulic line 30 is arranged on the side of the actuator ports of the directional control valve 16 for an attachment. The line 31 connects the hydraulic line 30 to a supply port 108A of the hydraulic breaker 108. The hydraulic line 32 is arranged on the side of the actuator ports of the directional control valve 16 for an attachment. The line 33 connects the hydraulic line 32 to a discharge port 108B of the hydraulic breaker 108.

A directional control valve 34 is provided in the line 33 and returns a hydraulic fluid that worked during the operation of the hydraulic breaker 108 to the tank 5. The lines 31 and 33 are connected to each other by a line 35. Breaker relief valves 36 and 37 are provided in the line 35. In this example, relief pressure of the breaker relief valve 37 is set to 100 kg/cm$^2$, for example.

A first over-load relief valve unit 38 for an attachment is provided in the hydraulic line 30 that is arranged on the side of the actuator ports of the directional control valve 16 for an attachment in the hydraulic circuit for an attachment. The first over-load relief valve unit 38 includes a check valve 38A and a relief valve 39B. A second over-load relief valve unit 39 for an attachment is provided in the hydraulic line 32 that is arranged on the side of the actuator ports of the directional control valve 16 for an attachment in the hydraulic circuit for an attachment. The second over-load relief valve unit 39 includes a check valve 39A and a relief valve 39B. In this example, relief pressure of the relief valves 38B and 29B is set to 300 kg/cm$^2$, for example.

The hydraulic circuit for an attachment is connected to a first proportional solenoid valve 40, a second proportional solenoid valve 41 and a solenoid valve 42. The first proportional solenoid valve 40 controls set pressure of the relief valve 38B that is included in the first over-load relief valve unit 38 (for attachment) provided in the hydraulic line 30 arranged on the side of the actuator ports of the directional control valve 16 for an attachment in the hydraulic circuit for an attachment. The first proportional solenoid valve 40 also controls set pressure of the breaker relief valve 37 that is provided in the line 35. The second proportional solenoid valve 41 controls set pressure of the relief valve 39B that is included in the second over-load relief valve unit 39 (for attachment) provided in the hydraulic line 32 arranged on the side of the actuator port of the directional control valve 16 for attachment. The solenoid valve 42 switches the directional control valve 34 and the breaker relief stop valve 36 to change the hydraulic circuit for an attachment to that for the hydraulic breaker or for a crusher.

The first proportional solenoid valve 40 is provided to supply the hydraulic fluid (for pilot operation) supplied from the auxiliary pump 4 through a pilot operation line 43 to a pilot operating section of the relief valve 38B, supply the hydraulic fluid (for pilot operation) supplied from the auxiliary pump 4 through a pilot operation line 44 to a pilot operating section of the breaker relief valve 37, and control set pressure of each of the relief valves 38B and 37. The second proportional solenoid valve 41 is provided to supply the hydraulic fluid (for pilot operation) supplied from the auxiliary pump 4 through a pilot operation line 45 to a pilot operating section of the relief valve 39B and control set pressure of the relief valve 39B.

The solenoid valve 42 is provided to supply the hydraulic fluid (for pilot operation) supplied from the auxiliary pump 4 through a pilot operation line 46 to a pilot operating section of the breaker relief stop valve 36 and supply the hydraulic fluid (for pilot operation) supplied from the auxiliary pump 4 through a pilot operation line 47 to a pilot operating section of the directional control valve 34. The solenoid valve 42 switches the directional control valve 34 and the breaker relief stop valve 36 to change the hydraulic circuit for an attachment to that for the hydraulic breaker or the circuit for the crusher. The hydraulic breaker 108 is installed as an attachment, as shown in FIG. 2. However, the directional control valve 34 and the breaker relief stop valve 36, which are shown in FIG. 2, are located so that the crusher can be supported when the crusher is installed as an attachment.

Figure 3:
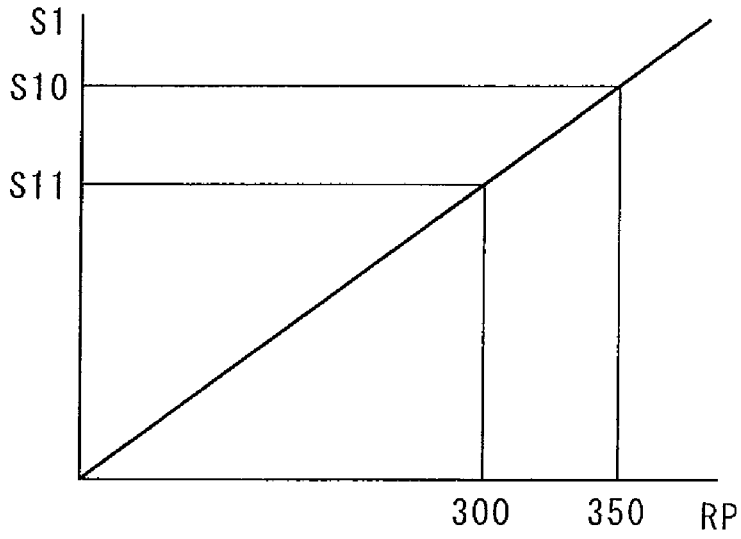
FIG. 3 is a diagram showing an example of characteristics of a set relief pressure value stored in a storage section included in a controller that constitutes a part of the hydraulic circuit system for a hydraulic excavator of the present invention.

The first proportional solenoid valve 40, the second proportional solenoid valve 41 and the solenoid valve 42 are connected to a controller 50 and a work input setting device 60. The controller 50 includes a storage section and an arithmetic section. As shown in FIG. 3, in order to allow the hydraulic circuit for an attachment to support the hydraulic breaker or the crusher, the storage section included in the controller 50 stores a set relief pressure characteristic A that indicates the relationship between set relief pressure RP of the relief valves 38B, 39B included in the first and second over-load relief valve unit 38, 39 and a command signal S1 that is to be transmitted to the first and second proportional solenoid valves 40 and 41. In this example, when the set relief pressure R is to be set to 350 kg/cm$^2$, a command signal S10 corresponding to the set relief pressure R is output, as the command signal S1, to the first and second proportional solenoid valves 40 and 41. When the set relief pressure R is to be set to 300 kg/cm$^2$, a command signal S11 corresponding to the set relief pressure R is output, as the command signal S1, to the first and second proportional solenoid valves 40 and 41.

Figure 4:
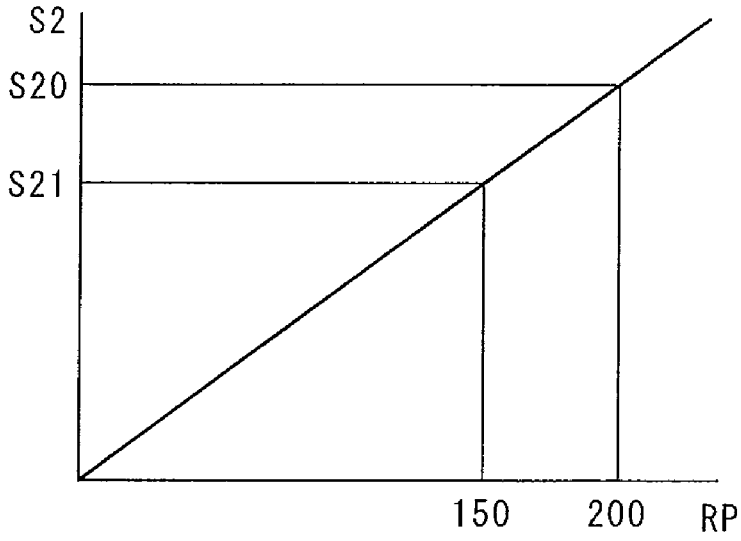
FIG. 4 is a diagram showing an example of characteristics of another set relief pressure value stored in the storage section included in the controller that constitutes the part of the hydraulic circuit system for a hydraulic excavator of the present invention.

As shown in FIG. 4, the storage section included in the controller 50 stores a set relief pressure characteristic B that indicates the relationship between set relief pressure RP of the breaker relief valve 37 in the hydraulic circuit for an attachment and a command signal S2 that is to be transmitted to the first proportional solenoid valve 40. In this example, when the set relief pressure RP is to be set to 200 kg/cm$^2$, a command signal S20 corresponding to the set relief pressure RP is output, as the command signal S2, to the first proportional solenoid valve 40. When set relief pressure RP is to be set to 150 kg/cm$^2$, a command signal S21 corresponding to the set relief pressure RP is output, as the command signal S2, to the first proportional solenoid valve 40.

For the characteristics (shown in FIGS. 3 and 4) stored in the storage section included in the controller 50, the command signal S11 is associated with the command signal S12 so as to be equivalent so that the first proportional solenoid valve 40 adjusts the set relief pressure of the relief valve 38B included in the first over-load relief valve unit 38 and the set relief pressure of the breaker relief valve 37 by means of the hydraulic fluid for pilot operation when the hydraulic breaker is used.

When the arithmetic section included in the controller 50 receives, from the work input setting device 60, a command that indicates that the hydraulic circuit for an attachment is used as that for the hydraulic breaker, the arithmetic section outputs a command signal to the second proportional solenoid valve 41 so that the set relief pressure RP of the relief valve 39B included in the second over-load relief valve unit 39 is set to, for example, 350 kg/cm$^2$. In addition, the set relief pressure RP of the breaker relief valve 37 is set to, for example, 150 kg/cm$^2$ by means of the first proportional solenoid valve 40. Furthermore, the arithmetic section outputs a command signal to the solenoid valve 42 so that a connection position of the directional control valve 34 is switched to the side of the tank. In addition, the solenoid valve 42 has a function of switching the breaker relief stop valve 36 to an opening state.

In addition, when the arithmetic section included in the controller 50 receives, from the work input setting device 60, a command signal that indicates that the hydraulic circuit for an attachment is used for the crusher, the arithmetic section outputs a command signal to the first proportional solenoid valve 40 so that the set relief pressure of the relief valve 38B included in the first over-load relief valve unit 38 is set to, for example, 300 kg/cm$^2$. In addition, the arithmetic section outputs a command signal to the second proportional solenoid valve 41 so that the set relief pressure RP of the relief valve 39B included in the second over-load relief valve unit 39 is returned to, for example, 300 kg/cm$^2$. Furthermore, the arithmetic section stops outputting the command signal to the solenoid valve 42 so that the directional control valve 34 is returned to the original position. In addition, the solenoid valve 42 has a function of switching the breaker relief stop valve 36 to a closed state.

The work input setting device 60 includes a key section 61 used for work selection and a screen section 62. The key section 61 is used to change a work mode and set values and select a hydraulic breaker, a crusher having crushing nails or the like. The screen section 62 displays data displayed on a display screen of the crusher, data displayed on a display screen of the hydraulic breaker, the state quantity of each device, and the like.

Operations of the hydraulic circuit system for a hydraulic excavator according to the embodiment of the present invention are described below with reference to FIGS. 1, 2, 5 and 6.

As shown in FIG. 2, when the key section of the work input setting device 60 is operated to input a command signal that indicates that the hydraulic breaker 108 is used under the condition that the hydraulic circuit for an attachment, which is included in the hydraulic circuit system for a hydraulic excavator according to the present invention, is attached to the hydraulic breaker 108, the work input setting device 60 outputs, to the controller 50, the command signal indicating that the hydraulic breaker 108 is used.

Figure 5:
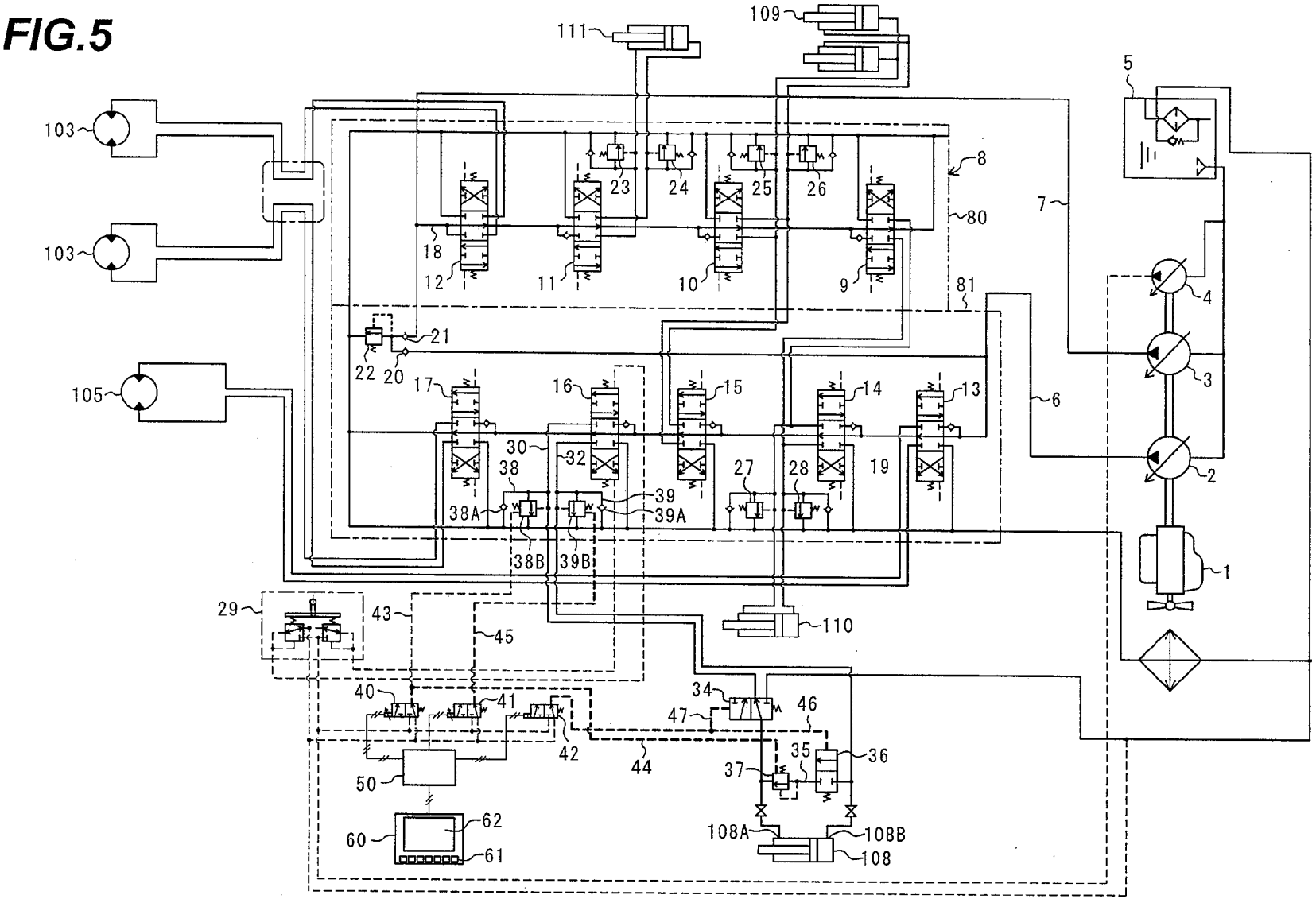
FIG. 5 is a circuit diagram showing operations that are performed in the embodiment in the case where the hydraulic breaker is attached to the hydraulic circuit for an attachment in the hydraulic circuit system (shown in FIG. 2) for a hydraulic excavator according to the present invention.

The controller 50 receives the command signal indicating that the hydraulic breaker 108 is used. Then, the controller 50 outputs an opening switch signal to the first proportional solenoid valve 41 as shown in FIG. 5. In response to the switch signal, the first proportional solenoid valve 41 supplies the hydraulic fluid (for pilot operation) supplied from the auxiliary pump 4 to the pilot operating section of the relief valve 39B included in the second over-load relief valve unit 39 as shown by a relatively bold line of FIG. 5. Thus the set relief pressure RP of the relief valve 39B is changed from a preset value of, for example, 300 kg/cm$^2$ to a high-pressure value of, for example, 350 kg/cm$^2$ to respond to high pressure pulsation that will occur in the hydraulic circuit. In addition, the second proportional solenoid valve 40 is switched to an opening state by means of the command signal indicating that the hydraulic breaker 108 is used. The second proportional solenoid valve 40 supplies the hydraulic fluid (for pilot operation) supplied from the auxiliary pump 4 to the pilot operating section of the breaker relief valve 37 as shown by a relatively bold line of FIG. 5 so that the set relief pressure RP of the breaker relief valve 37 is set to, for example, 150 kg/cm$^2$.

In addition, the controller 50 receives the command signal indicating that the hydraulic breaker 108 is used. Then, the controller 50 outputs an opening signal to the solenoid valve 42. In response to the opening signal, the solenoid valve 42 supplies the hydraulic fluid (for pilot operation) supplied from the auxiliary pump 4 to the directional control valve 34 and the breaker relief stop valve 36 as shown by relatively bold lines of FIG. 5. Thus the connection position of the directional control valve 34 is switched to the side of the tank and the breaker relief stop valve 36 is switched to an opening state.

This allows the hydraulic circuit for an attachment to be set and adjusted for the hydraulic breaker 108. When the directional control valve 16 is changed from a neutral position to a left-side position by operating the control lever device 29 provided in the cab 112, the hydraulic fluid is supplied from the first hydraulic pump 2 to the hydraulic breaker 108. Thus the hydraulic breaker 108 can be operated.

Figure 6:
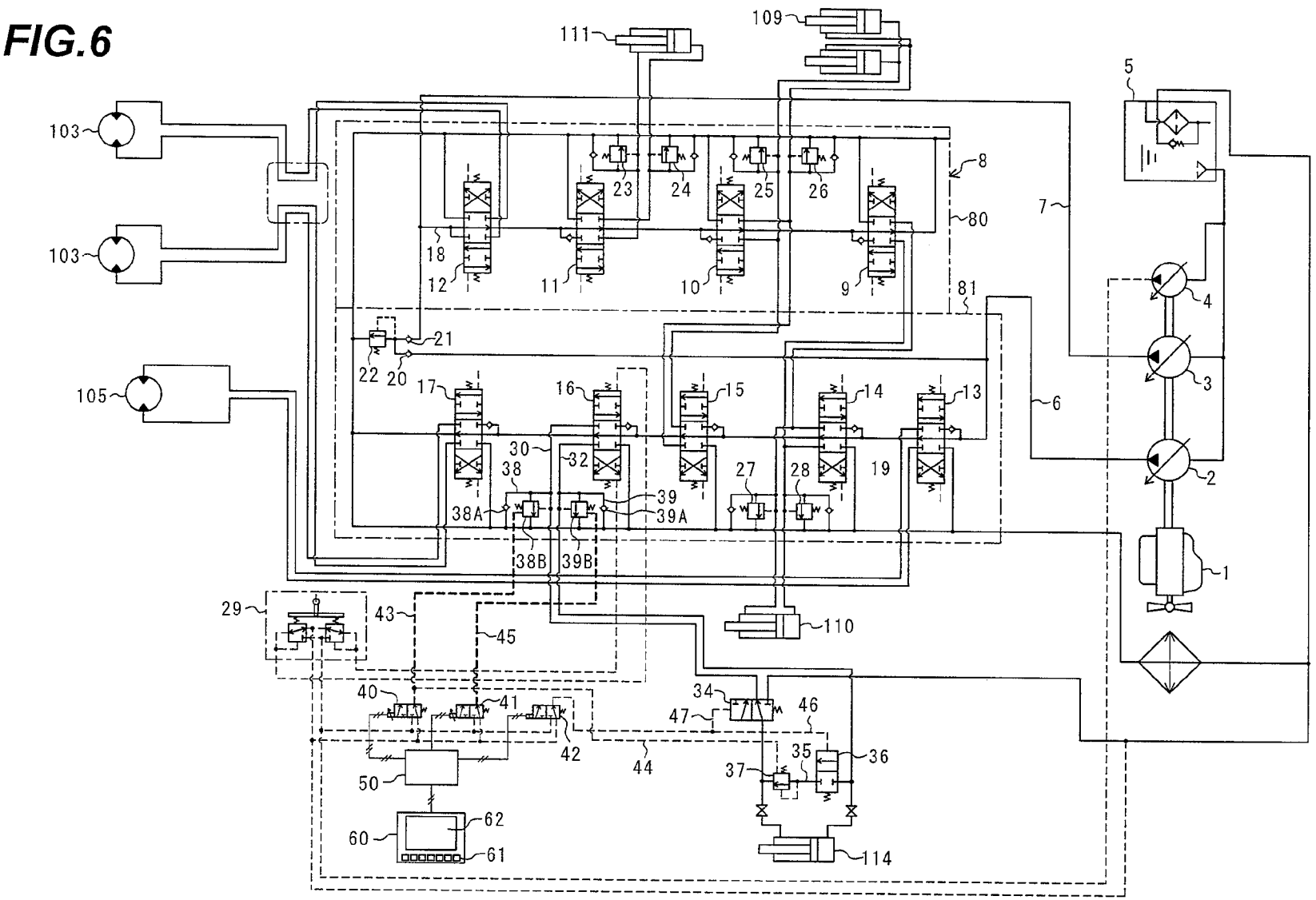
FIG. 6 is a circuit diagram showing operations that are performed in the embodiment in the case where a crusher is attached to the hydraulic circuit for an attachment in the hydraulic circuit system for a hydraulic excavator according to the present invention.

In order that the crusher having the crushing nails is attached to the hydraulic circuit for an attachment in the hydraulic circuit system for a hydraulic excavator according to the present invention and the crusher is used, the following procedures are performed. When the key section of the work input setting device 60 is operated to input a command signal that indicates that the crusher is used under the condition that a hydraulic cylinder 114 used to operate the crusher is installed as shown in FIG. 6, the work input setting device 60 outputs, to the controller 50, the command signal that indicates that the crusher is used.

The controller 50 receives the command signal indicating that the crusher is used. Then, the controller 50 outputs an opening switch signal to the first proportional solenoid valve 40 as shown in FIG. 6. In response to the opening switch signal, the first proportional solenoid valve 40 supplies the hydraulic fluid for pilot operation to the pilot operating section of the first over-load relief valve 38 as shown by a broken line to set the relief pressure RP. In addition, the first proportional solenoid valve 40 outputs an opening switch signal to the second proportional solenoid valve 41. In response to the opening switch signal, the second proportional solenoid valve 41 supplies the hydraulic fluid (for pilot operation) supplied from the auxiliary pump 4 to the pilot operating section of the relief valve 39B included in the second over-load relief valve unit 39 as shown by a relatively bold line of FIG. 6, so that the set relief pressure RP of the relief valve 39B is set to the set relief pressure (for example, 300 kg/cm$^2$) identical to the set pressure (for example, 300 kg/cm$^2$) of the relief valve 38B included in the second over-load relief valve unit 38.

In addition, the controller 50 receives the command signal indicating that the crusher is used and outputs a closing signal to the solenoid valve 42. Thus, The directional control valve 34 changes the state of the line 33 to a communicating state, and the breaker relief stop valve 36 is changed to a closed state.

In the aforementioned manner, the hydraulic circuit for an attachment can be set for the crusher. Thus, when the directional control valve 16 is switched from the neutral position to, for example, a right-side position or a left-side position by the control lever device 29 provided in the cab 112, the hydraulic fluid supplied from the first hydraulic pump 2 can be supplied to the hydraulic cylinder 14 for operation of the crusher. In this manner, the crusher can be operated.

In the hydraulic circuit system according to the embodiment of the present invention, the hydraulic circuit for an attachment can be easily set for the attachment (such as the hydraulic breaker or the crusher) attached to the hydraulic circuit and having various characteristics and capacity and can be easily adjusted. As a result, the versatility of the hydraulic circuit for an attachment is improved. In addition, it is possible to provide a hydraulic circuit system for a hydraulic excavator which is simple in setting adjustment without increase in cost.

In the present embodiment, the pressure of the relief valve 38B included in the first over-load relief valve unit 38 and the pressure of the relief valve 39B included in the second over-load relief valve unit 39 are set to, for example, 300 kg/cm$^2$, and the relief pressure of the breaker relief valve 37 is preset to, for example, 150 kg/cm$^2$. However, the set relief pressure values can be changed on the basis of the attachment (such as the hydraulic breaker or the crusher) that is connected to the hydraulic circuit for an attachment and has various characteristics and capacity. In the aforementioned example, the pressure of the relief valve 38B included in the first over-load relief valve unit 38 and the pressure of the relief valve 39B included in the second over-load relief valve unit 39 are set to, for example, 300 kg/cm$^2$, and the relief pressure of the breaker relief valve 37 is preset to, for example, 150 kg/cm$^2$. However, the pressure of the relief valve 38B and the pressure of the relief valve 39B may be set to other pressure values.

Each of the preset relief pressure values can be changed based on the attachment having various characteristics and capacity, such as the hydraulic breaker or the crusher, by applying pressure of the hydraulic fluid (for pilot operation) supplied from the auxiliary pump 4 to the pilot operating section of each relief valve on the basis of the characteristics shown in FIGS. 3 and 4.

In this manner, the attachments having various characteristics and capacity, such as the hydraulic breaker or the crusher can be applied by changing each of the set relief pressure values. Thus, the versatility of the hydraulic circuit system for a hydraulic excavator is improved. In addition, the configuration of the circuit is simple.

A cutter, a grapple and the like can be attached as an attachment in addition to the crusher.

DESCRIPTION OF REFERENCE NUMERALS

16 Directional control valve for attachment
29 Control lever device
34 Directional control valve
36 Breaker relief stop valve
37 Breaker relief valve
38 First over-load relief valve unit
39 Second over-load relief valve unit
40 First proportional solenoid valve
41 Second proportional solenoid valve
42 Solenoid valve
50 Controller
60 Work input setting device

The invention claimed is:

1. A hydraulic circuit system for a hydraulic excavator, which includes a hydraulic circuit for an attachment which allows at least a hydraulic breaker and a crusher to be attached as a front attachment for the hydraulic excavator, the hydraulic breaker crushing a rock and the like and the crusher being used for a disassembling operation, the system comprising:

a directional control valve that supplies and discharges a hydraulic fluid to and from an attachment connected to the hydraulic circuit for an attachment;

a first over-load relief valve unit including a check valve and a variable relief valve, the first over-load relief valve unit provided in the one of lines of the hydraulic circuit for an attachment;

a second over-load relief valve unit including a check valve and a variable relief valve, the second over-load relief valve unit provided in the other of the lines of the hydraulic circuit for an attachment;

a breaker relief valve and a breaker relief stop valve that are provided between the one of the lines of the hydraulic circuit for an attachment and the other of the lines of the hydraulic circuit for an attachment;

a first proportional solenoid valve that is connected to the relief valve included in the first over-load relief valve unit and the breaker relief valve, the first proportional solenoid valve for controlling set pressure of the relief valve included in the first over-load relief valve unit and set pressure of the breaker relief valve;

a second proportional solenoid valve that controls set pressure of the relief valve included in the second over-load relief valve unit; and a solenoid valve that opens and closes the breaker relief stop valve.

2. The hydraulic circuit system for a hydraulic excavator according to claim 1, further comprising a directional control valve that is provided in the other of the lines of the hydraulic circuit for an attachment, the directional control valve being connected to the breaker on the side of a tank, wherein the directional control valve can be opened and closed in operative association with opening and closing operations of the breaker relief valve.

3. The hydraulic circuit system for a hydraulic excavator according to claim 1, further comprising:

a work input setting device that changes a work mode and set values and selects the type of the attachment such as the hydraulic breaker or the crusher having crushing nails; and a controller used to open and close the first proportional solenoid valve, the second proportional solenoid valve and the solenoid valve according to a command transmitted from the work input setting device.

4. The hydraulic circuit system for a hydraulic excavator according to claim 3, wherein the work input setting device includes: a key section that changes the work mode and the set values and selects the type of the attachment; and a screen section that displays the type of the attachment and the state quantity of each device.

5. The hydraulic circuit system for a hydraulic excavator according to claim 3, wherein the controller receives a command signal from the work input setting device, thereby allowing the first proportional solenoid to control set relief pressure of the relief valve included in the first over-load relief valve unit and set relief pressure of the breaker relief valve.

* * * * *